US007174943B2

(12) United States Patent
Wang

(10) Patent No.: US 7,174,943 B2
(45) Date of Patent: Feb. 13, 2007

(54) CURTAIN HOISTING CLUTCH APPARATUS

(76) Inventor: Wen-Jen Wang, No. 49, Ren-Ai Rd., Ren-Ho Village, Linbian Township, Pingtung County (TW)

( * ) Notice: Subject to any disclaimer, the term of this patent is extended or adjusted under 35 U.S.C. 154(b) by 141 days.

(21) Appl. No.: 10/995,250

(22) Filed: Nov. 24, 2004

(65) Prior Publication Data

US 2006/0108077 A1 May 25, 2006

(51) Int. Cl.
*E06B 9/324* (2006.01)

(52) U.S. Cl. ..... 160/178.2

(58) Field of Classification Search ..... 160/178.2, 160/178.1 R, 178.1 V, 168.1 R, 173 R, 173 V, 160/167 R; 24/136 R, 136 K, 115 L, 115 M
See application file for complete search history.

(56) References Cited

U.S. PATENT DOCUMENTS 4,955,420 A * 9/1990 Marinescu et al. ..... 160/178.2
4,957,152 A * 9/1990 Knight et al. ..... 160/345
5,109,908 A * 5/1992 Chen ..... 160/84.01
5,156,196 A * 10/1992 Corey et al. ..... 160/178.2
5,263,528 A * 11/1993 Patel ..... 160/178.2
5,472,036 A * 12/1995 Judkins ..... 160/178.2

* cited by examiner

*Primary Examiner*—David Purol
(74) *Attorney, Agent, or Firm*—Birch, Stewart, Kolasch, and Birch, LLP

(57) ABSTRACT

An improved curtain hoisting apparatus is wedged to a left end of a track and mainly includes a gear located on the bottom of an anchor body. The gear has a spindle pin movable in an m-shaped channel formed on an inner side of a wedge plate. The spindle pin is allowed to move and anchor in a first channel of the m-shaped channel to loosen a curtain cord for hoisting the curtain panel to a selected elevation. Pulling the curtain cord one more time allows the spindle pin moving from the first channel towards a second channel until anchoring at an outer rim at the left side of the m-shaped channel to brake the curtain cord thereby to halt the curtain panel at the selected elevation. Pulling the curtain cord repeatedly, the curtain panel may be hoisted and halted alternately and easily at selected elevations.

1 Claim, 7 Drawing Sheets

CURTAIN HOISTING CLUTCH APPARATUS

FIELD OF THE INVENTION

The present invention relates to a curtain hoisting clutch system and particularly an improved curtain hoisting clutch apparatus for extending and hoisting curtain to selected elevations freely.

BACKGROUND OF THE INVENTION

Window coverings such as curtains, draperies and shade and blinds have been widely used in households and office environments. The opening (hoisting) and closing (extending) of the curtains mostly are done by pulling cords. This type of operation generally is adapted for Venetian blinds or curtains composed of a left and a right panel, but is not adaptable for one piece hoisting shade or curtain. Moreover, in conventional curtain hoisting clutch systems, when the cord is pulled bias to the right and then straightened again, the curtain will be fully extended. Pull the cord bias to the right again, the cord will be halted and the curtain will be rolled to the top end. Such clutch systems can either fully extend the curtain or completely roll the curtain, but cannot control the rolling of the curtain to any desired elevation. Hence their applications are limited.

SUMMARY OF THE INVENTION

In view of the foregoing disadvantages, the primary object of the invention is to provide an improved curtain hoisting clutch apparatus that allows the curtain extending or hoisting to any selected elevation desired. In the invention, a curtain clutch means is mounted to the left hand side of the track. Pulling the curtain cord once, the curtain panel will be extended clockwise to a selected elevation. Pulling the cord the second time, the curtain panel will be moved up and halted at the selected elevation. By repeating the pulling actions, the curtain may be extended or halted easily at selected elevations.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
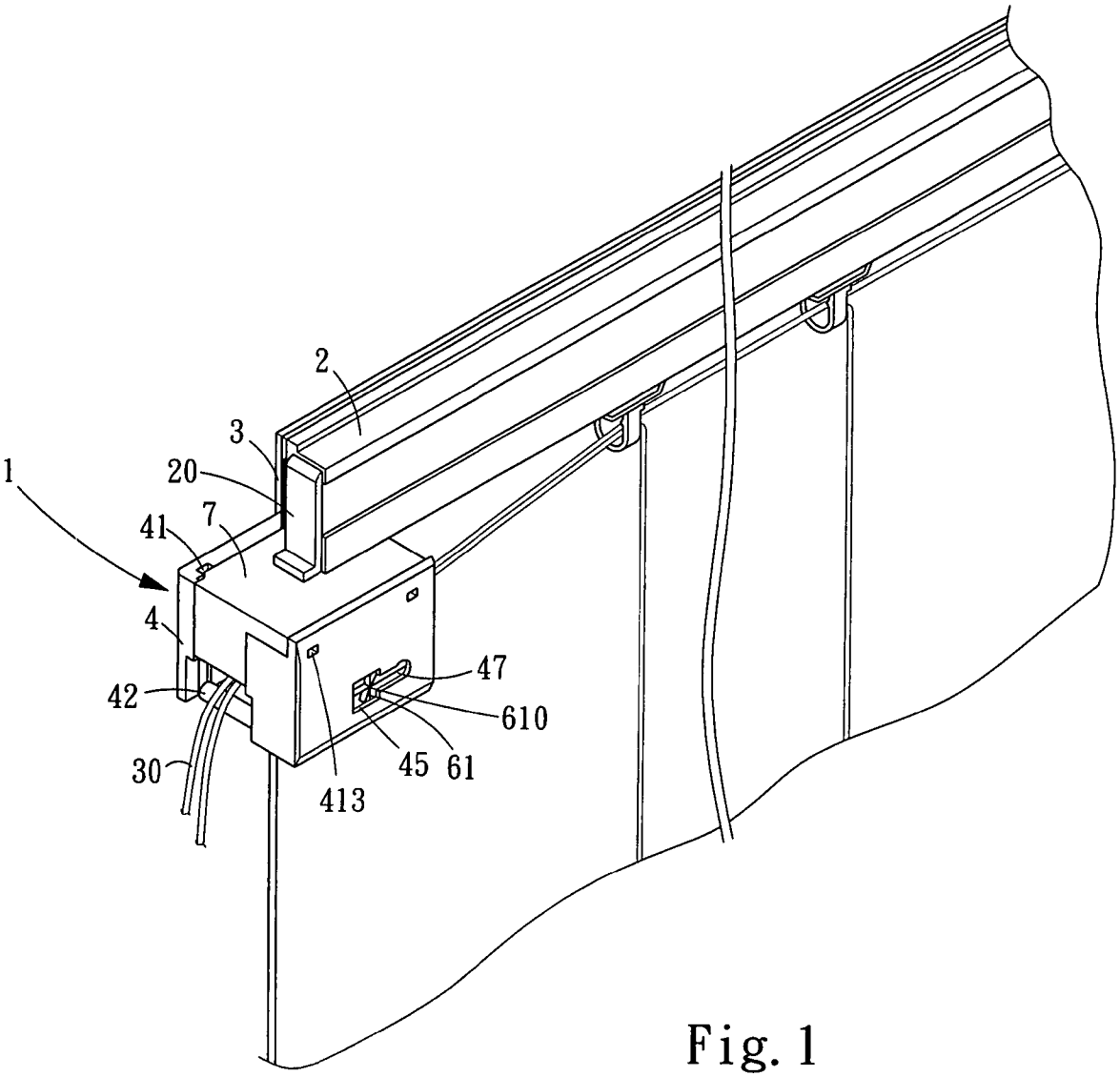
FIG. 1 is a perspective view of the invention, after installation.
Figure 2:
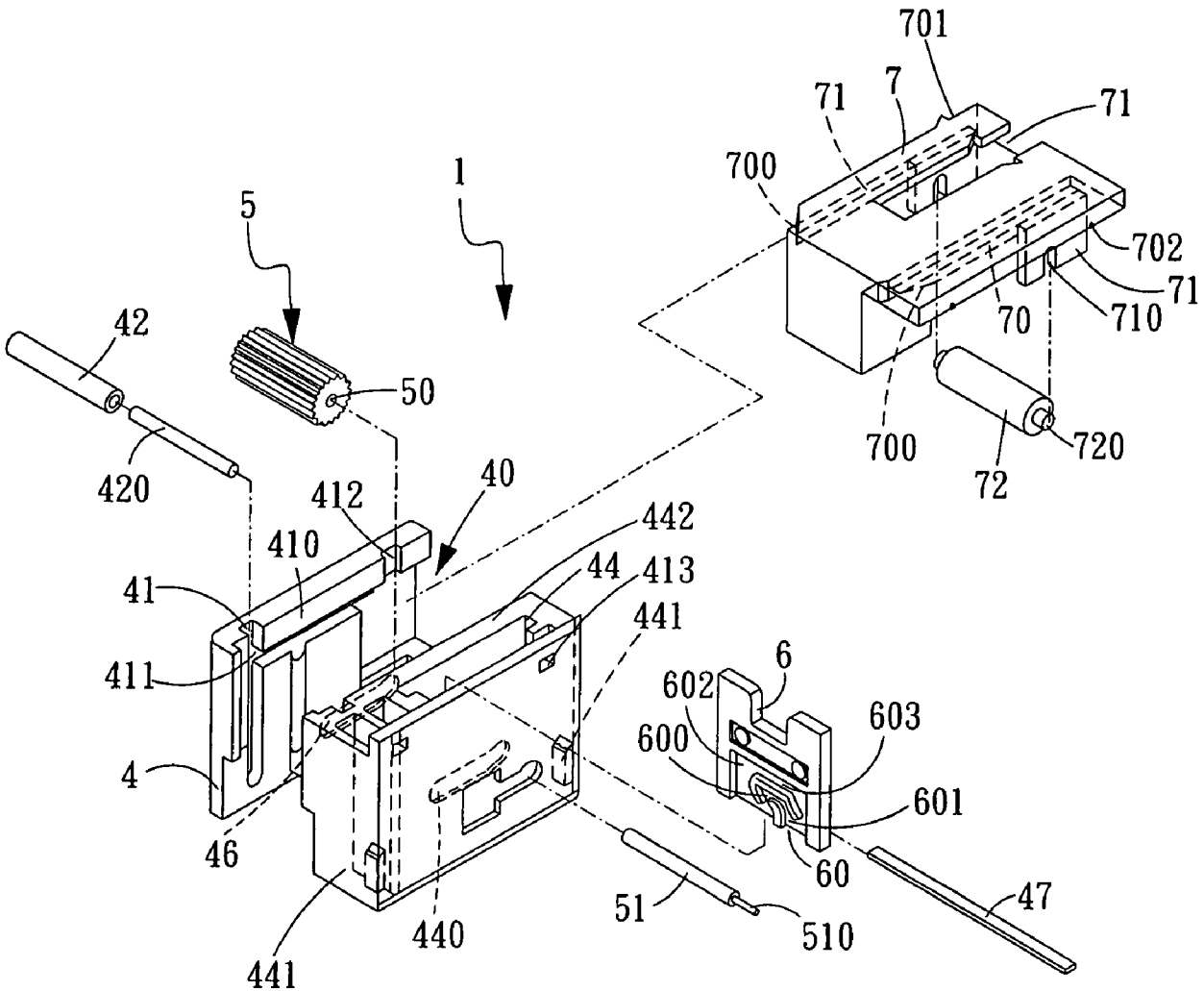
FIG. 2 is an exploded view of the invention.

Referring to FIGS. 1 and 2, the curtain hoisting clutch apparatus 1 of the invention is wedged to a lower side of a left end of a track 2 by means of a fastening block 20 to control a moving of a curtain panel 3 located at the rear side of the track 2 through a curtain cord 30. Pulling the curtain cord 30 once, the curtain panel 3 will be hoisted to a selected elevation. Pulling the curtain cord 30 another time, the curtain panel 3 will be halted at the selected elevation. The hoisting clutch apparatus 1 consists of an anchor body 4, a gear 5, a wedge plate 6 and a lid 7.

Figure 4:
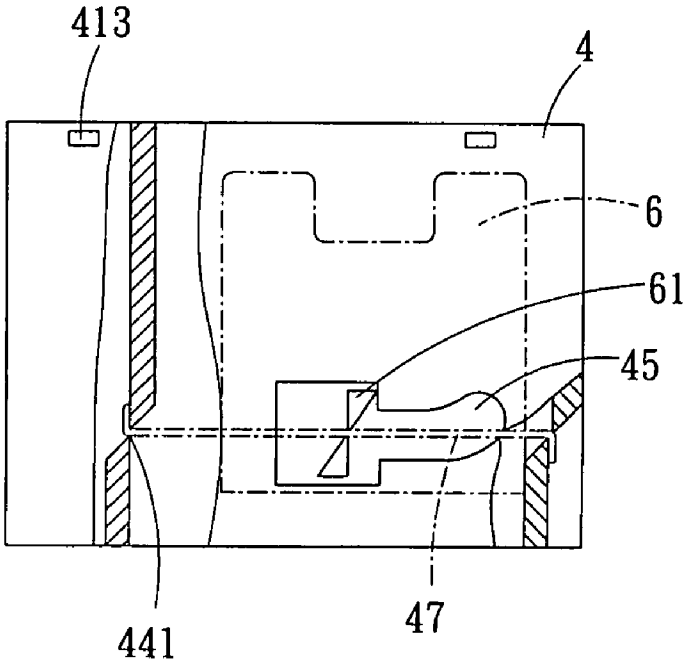
FIG. 4 is a front view, partly cutaway, of the anchor body of the invention.
Figure 3:
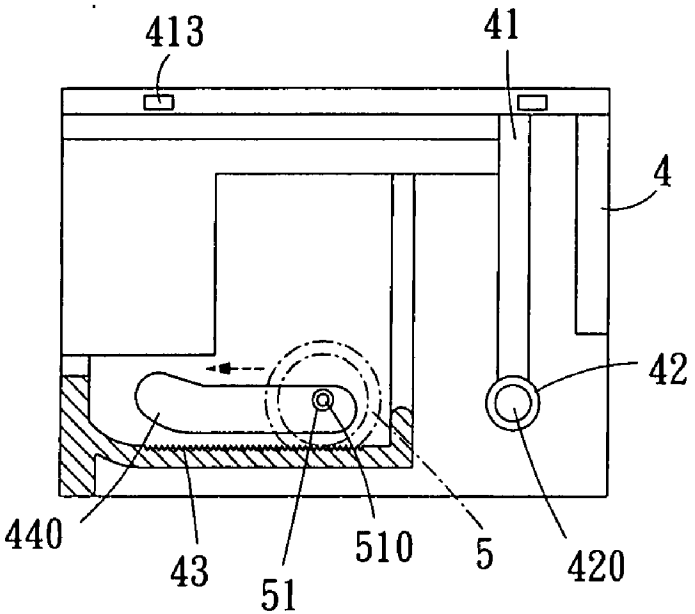
FIG. 3 is a rear cross section of an anchor body of the invention.

The anchor body 4 is an U-shaped frame having an opening 40 on the top side, and two mating and opposing side walls 410 each has a longitudinal trough 41 for movably coupling with a shaft 420 of a roller 42 and a transverse trough 411 formed proximate to the top side thereof for wedging flanges 70 formed at two sides of the bottom of the lid 7. On the bottom side of the anchor body 4, there is a gear rack 43 engageable with the gear 5 as shown in FIG. 3. The gear 5 has a center hole 50 housed a spindle 51 therein. The spindle 51 has a movable spindle pin 510 formed at a front end which is movable in a m-shaped channel 60 formed on an inner side of the wedge plate 6 which is located in a channel zone 44 formed in the front side of the anchor body 4. At the lower portion of the side wall 410 corresponding to the spindle 51, there is a T-shaped opening 45 which has one end tilted slightly upwards, and a first elongated channel 46. On an outer wall 442 of the channel zone 44 at a lower section there is a second elongated channel 440 formed on. The spindle 51 is movable in the T-shaped opening 45, and the first and second elongated channel 46 and 440. The channel zone 44 further has two ends each has an aperture 441 formed thereon for holding an elastic strip 47 therebetween. The elastic strip 47 is wedged through a gap 610 formed between two opposing triangular blocks 61 located on an outer side of the wedge plate 6 as shown in FIG. 4, and may move the wedge plate 6 up or down.

The gear 5 has the center hole 50 housed the spindle 51 therein with the spindle pin 510 formed at the front end of the spindle 51. The spindle 51 is movable in the first elongated channel 46 and the second elongated channel 440 formed respectively on the side wall 410 of the anchor body 4 and the outer wall 442 of the channel zone 44. The gear 5 has teeth 500 on the periphery to engage with the gear rack 43 at the bottom of the anchor body 4 such that the spindle pin 510 is movable reciprocally.

The wedge plate 6 has the m-shaped channel 60 formed on the inner side at a lower portion which includes a first channel 600 and a second channel 601 to allow the spindle pin 510 moving therein. The triangular blocks 61 are located on the outer side of the wedge plate 6 corresponding to the m-shaped channel 60 and have the gap 610 formed therebetween to wedge the elastic strip 47. The elastic strip 47, through its elastic force, may move the wedge plate 6 up or down.

The lid 7 has a T-shaped ledge 71 formed on the top side thereof for wedging the fastening block 20 of the track 2. The wedging flanges 70 formed at two sides of the bottom of the lid 7 have respectively a slant surface 700 at the front end to slide and wedge in the transverse troughs 411 of the side walls-410 of the anchor body 4. The flanges 70 have lugs 710, 702 jutting from two ends to engage with notches 412, 413 formed on the top rim of the mating side walls 410. There is a T-shaped ledge 71 extended downwards from one side of the flange 70. The T-shaped ledge 71 has a longitudinal notch 710 formed on the side wall thereof to engage with a roller stub shaft 720 extending from either end of a roller 72. The roller 72 is located above the gear 5 and turnable in an opposite direction relative to the gear 5.

Figure 6:
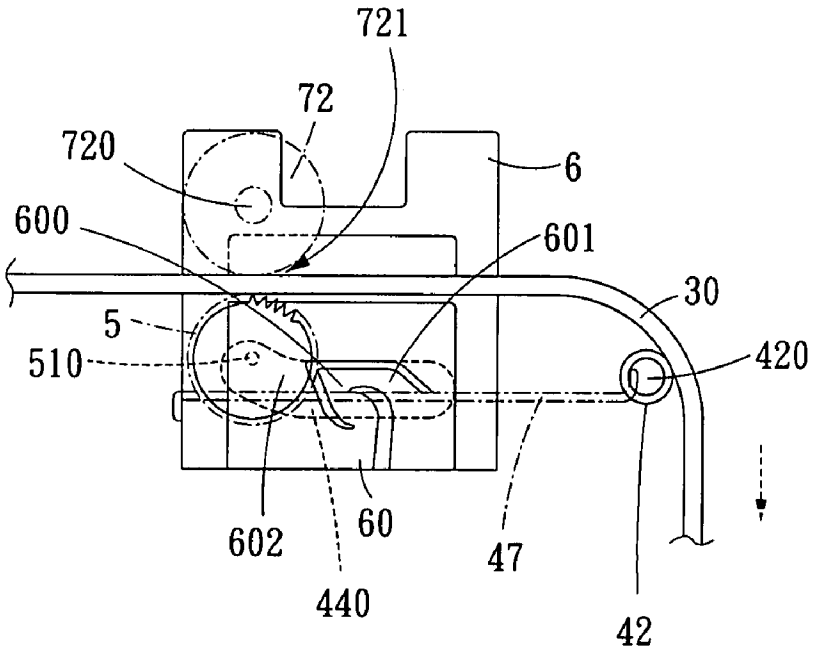
FIG. 6 is a schematic view of a spindle pin located at the outer rim on the left side of a m-shaped channel.
Figure 5:
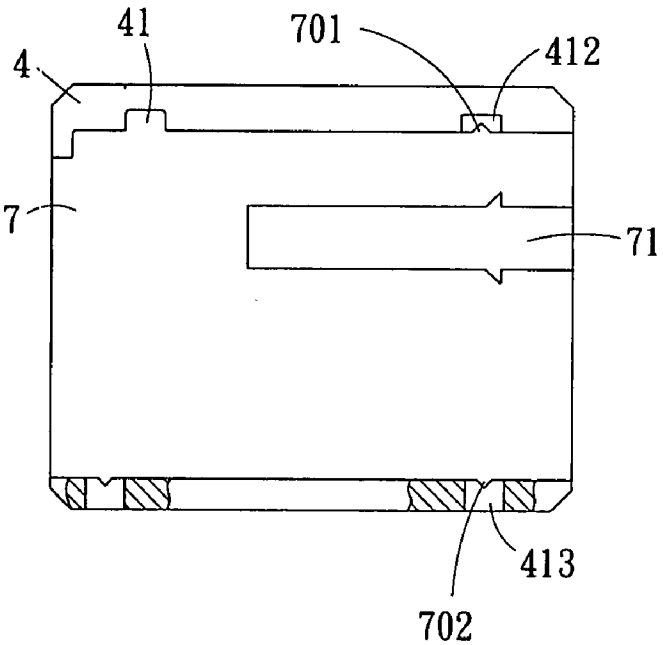
FIG. 5 is a top view of the anchor body of the invention.
Figure 8:
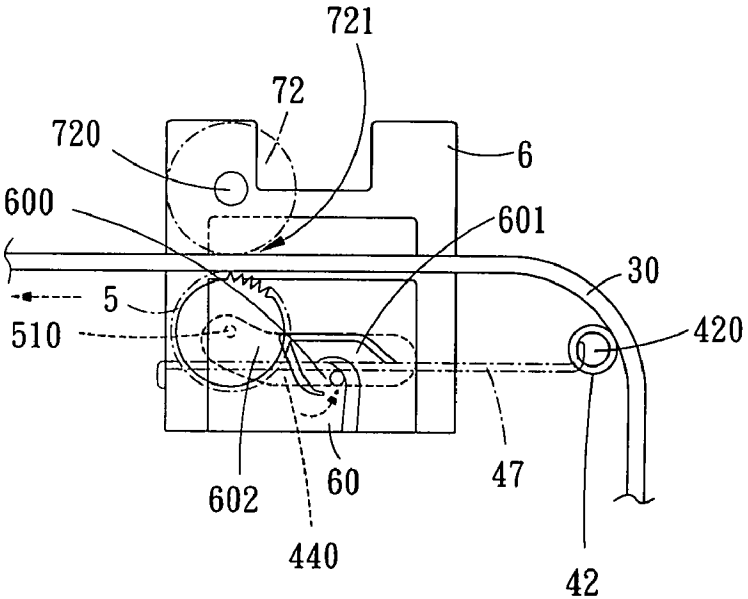
FIG. 8 is a schematic view of the spindle pin engaged in first channel of the m-shaped channel.
Figure 7:
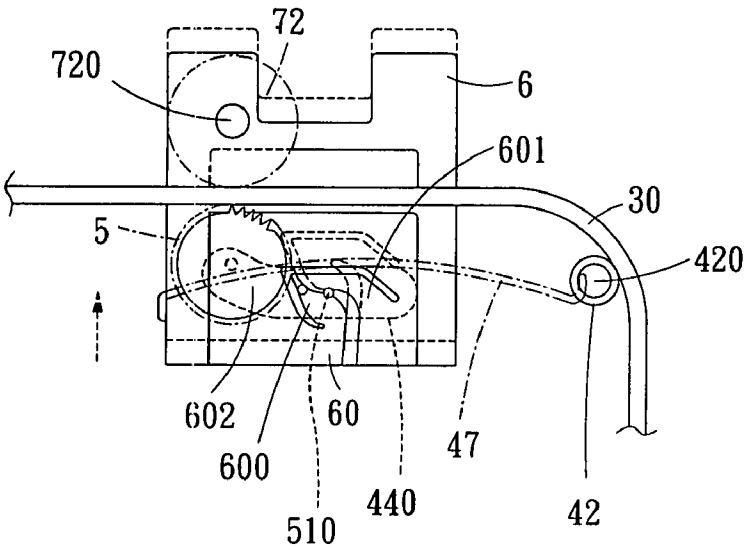
FIG. 7 is a schematic view of the spindle pin moving from the outer rim on the left side to a first channel of the m-shaped channel.
Figure 10:
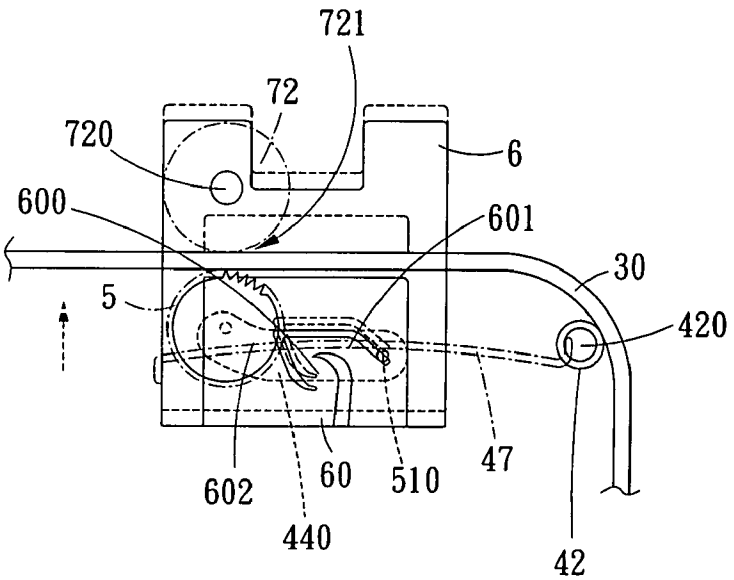
FIG. 10 is a schematic view of the spindle pin moving from the second channel to the outer rim on the left side of the m-shaped channel.
Figure 9:
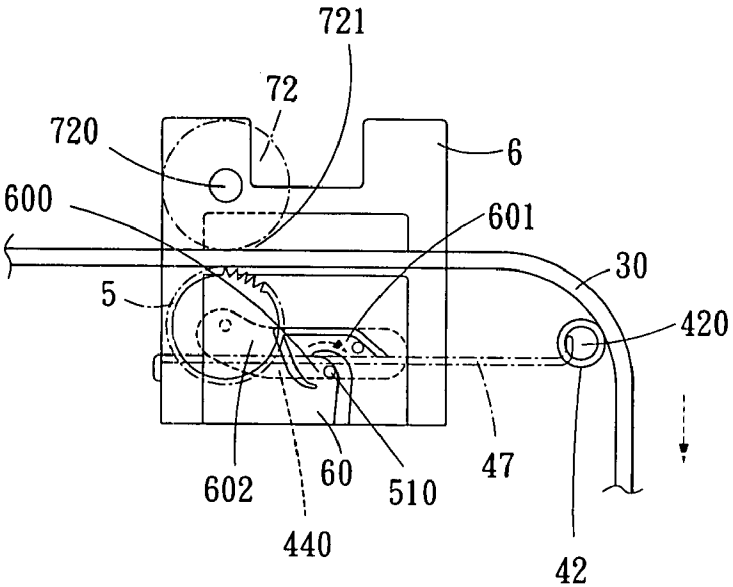
FIG. 9 is a schematic view of the spindle pin moving from the first channel to a second channel of the m-shaped channel.
Figure 12:
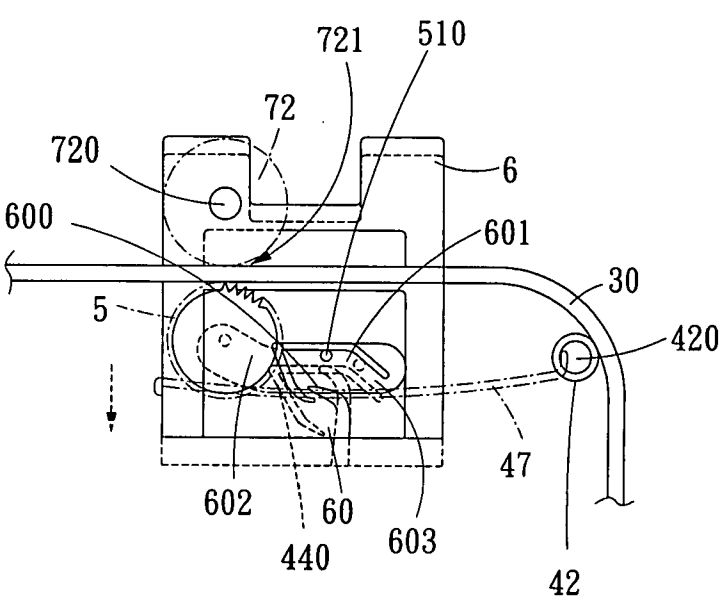
FIG. 12 is yet another schematic view of the spindle pin moving from the second channel to the outer rim on the left side of the m-shaped channel.
Figure 11:
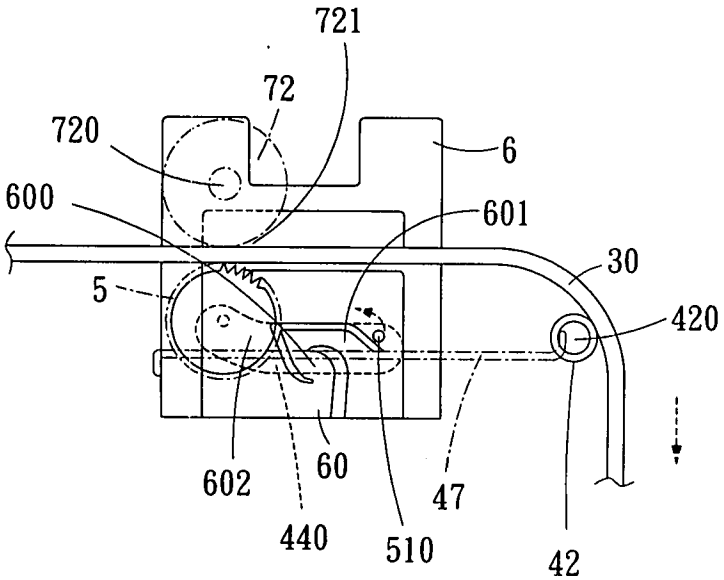
FIG. 11 is another schematic view of the spindle pin moving from the second channel to the outer rim on the left side of the m-shaped channel.

When the curtain hoisting clutch apparatus 1 thus constructed is in use, the spindle pin 510 of the gear 5 is moved on the gear rack of the anchor body from an outer rim 602 at the left side of the m-shaped channel 60 of the wedge plate 6 to the first channel 600 and anchoring there as shown in FIGS. 6, 7 and 8, the elastic strip 47 on the outer side of the wedge plate 6 will move the wedge plate 6 from a higher elevation to a lower and original elevation shown in FIG. 8 to increase a gap 721 formed between the gear 5 and roller 72 located at one side of the lid 7 thereby to loosen the cord 30 so that the curtain panel 3 may be hoisted to an elevation desired. Pulling the curtain cord 30 once more shown in FIG. 9, the spindle pin 510 of the gear 5 will be moved from the first channel 600 towards the second channel 601 then moved to an upper rim 603 of the m-shaped channel 60 to depress the wedge plate 6 downwards as shown in FIGS. 10, 11, 12 and anchor at the outer rim 602 at the left hand side; the wedge plate 6 will be moved by the elastic strip 47 from a lower elevation to a higher and original elevation shown in FIG. 6 to decrease the gap 721 between the gear 5 and roller 72 to brake the curtain cord 30 so that the curtain panel 3 will be halted at the elevation desired. Repeat the pulling of the curtain cord 30 once more, the curtain panel 3 may be hoisted again, and pulling the curtain cord 30 another time, the curtain panel 3 will be halted. Thus the curtain panel 3 may be controlled easily to hoist and halt at any elevation desired.

What is claimed is:

1. A curtain hoisting apparatus wedged to a lower side of a track, the curtain hoisting apparatus comprising:

a fastening block for controlling movement of a curtain panel located adjacent the track;

a curtain cord operatively connected to the curtain panel and extending through the fastening block, sequential operation of the curtain cord moving the curtain panel to a selected elevation and then halting the curtain panel at the selected elevation;

an anchor body having a U-shaped with an opening on a top side thereof, the anchor body having two mating opposed side walls, each side wall having a longitudinal trough and a transverse trough proximate to a top end of the side walls, a gear rack located at a bottom side of the anchor body, one side wall having a T-shaped opening therein, an end of the T-shaped opening being inclined, the inclined end of the T-shaped opening being adjacent a first elongated channel of the T-shaped opening;

an elastic strip;

a wedge plate located in the anchor body, the wedge plate having an m-shaped channel formed on an inner side wall thereof, the m-shaped channel being located at a channel zone formed in a front side of the anchor body, the m-shaped channel having a first channel and a second channel the anchor body having an aperture for holding the elastic strip, the elastic strip being held between two opposing triangular blocks located on an outer side of the wedge plate, the wedge plate being vertically movable by the elastic strip;

a gear, the gear being engageable with the gear rack of the anchor body, the gear having a center hole housing a spindle therein, the spindle having a front end formed with a movable spindle pin, the spindle pin being movable from an outer rim of the m-shaped channel to the first channel, and being movable from the first channel towards the second channel of the m-shaped channel of the wedge plate, the spindle being movable in the T-shaped opening on the one wall of the anchor body;

a roller having a roller stub shaft mounted in the longitudinal trough of the side walls of the anchor body, the roller being above the gear and being rotatable in a direction opposite to the gear, the curtain cord passing between the gear and the roller and the gear and the roller being movable toward and away from one another by movement of the wedge plate; and a lid having a T-shaped slot formed on a top side thereof for wedging the fastening block to the track, the lid further having wedging flanges formed on two sides on the bottom thereof, the wedging flanges having a slant surface to each slide and wedge in one the transverse trough of the side walls of the anchor body to thereby mate the lid with the anchor body, the flanges further having jutting lags formed at two ends thereof, the jutting lugs being engageable with notches formed on a top rim of the side walls of the anchor body, the T-shaped ledge extends downwards and has a longitudinal notch formed on a side wall thereof to engage with the roller stub shaft, wherein the elastic strip allows the wedge plate to move from an original elevation to a higher elevation or to a lower elevation to increase a gap between the gear and the roller to thereby loosen the curtain cord during movement of the curtain panel and the spindle pin being moved from the first channel towards the second channel then move to an upper rim of the m-shaped channel to depress the wedge plate to decrease the gap between the gear and the roller to brake the curtain cord for halting movement of the curtain panel.

* * * * *